United States Patent [19]

Hults

[11] 4,123,634

[45] Oct. 31, 1978

[54] SNAP-ACTION SWITCH WITH CONTACT WIPING ACTION

[75] Inventor: Harold W. Hults, New Berlin, Wis.

[73] Assignee: Cutler-Hammer, Inc., Milwaukee, Wis.

[21] Appl. No.: 789,262

[22] Filed: Apr. 20, 1977

[51] Int. Cl.[2] ..... H01H 13/28

[52] U.S. Cl. ..... 200/67 A; 200/339; 200/153 K

[58] Field of Search ..... 200/67 A, 67 G, 67 B, 200/153 E, 153 K, 154, 241, 244, 242, 260, 335, 339

[56] References Cited

U.S. PATENT DOCUMENTS

| | | | |
|---|---|---|---|
| 1,605,910 | 11/1926 | Appleton et al. | 200/68 |
| 1,912,623 | 6/1933 | Douglas | 200/67 A |
| 2,399,462 | 4/1946 | Bryant | 200/154 |
| 2,429,770 | 10/1947 | Popp | 200/67 A |
| 3,177,197 | 1/1964 | Carling et al. | 200/67 G |
| 3,311,716 | 3/1967 | Carlson | 200/67 A |
| 3,399,285 | 8/1968 | Haderer | 200/67 G |
| 3,403,237 | 9/1968 | Wysong | 200/67 G |
| 3,770,920 | 11/1973 | Poliak | 200/67 A |
| 3,999,024 | 12/1976 | Marquardt | 200/67 G |

FOREIGN PATENT DOCUMENTS

| | | | |
|---|---|---|---|
| 1,492,835 | 1967 | France | 200/67 A |
| 925,076 | 4/1963 | United Kingdom | 200/67 A |

*Primary Examiner*—J. V. Truhe
*Assistant Examiner*—M. Paschall
*Attorney, Agent, or Firm*—Hugh R. Rather; William A. Autio; Michael E. Taken

[57] ABSTRACT

An electric snap-action electric switch is disclosed which employs movable contact means having an inverted V-shaped cam surface. The movable contact means is spring biased into engagement along its cam surface with the end of a pivoted operator lever. Upon movement from one extreme position the lever cams and pivots the contact means inwardly of the switch until the end of the lever rides beyond the apex of the V-shaped surface, whereupon the contact means moves with snap action under spring action to change switch circuits. Contact wiping action occurs during inward pivotal movement of said contact means, and abutting stationary contact engagement results from its snap-action movement.

7 Claims, 6 Drawing Figures

SNAP-ACTION SWITCH WITH CONTACT WIPING ACTION

BACKGROUND OF THE INVENTION

There is need for electric switches of small size for both consumer appliance applications, and in low voltage-low current electronic apparatus. For consumer appliances, such switches must be capable of relatively high electrical ratings, while their use in electronic applications often requires satisfactory operation and circuit completion under, or near, "dry circuit" conditions. Competitive market conditions require that such switches be economical to manufacture, and that they avoid use of expensive contact materials.

OBJECTS OF THE INVENTION

It is a primary object of the present invention to provide an improved snap-action switch which is economical to manufacture, capable of high electrical ratings, and also useable in low voltage-low current applications, and A further more specific object is to provide a novel form of snap-action mechanism which is characterized by affording contact wiping action in circuit breaking operation, and abutting contact making operation.

Other objects and advantages of the invention will hereinafter appear.

DESCRIPTION OF THE PREFERRED EMBODIMENT

Figure 1:
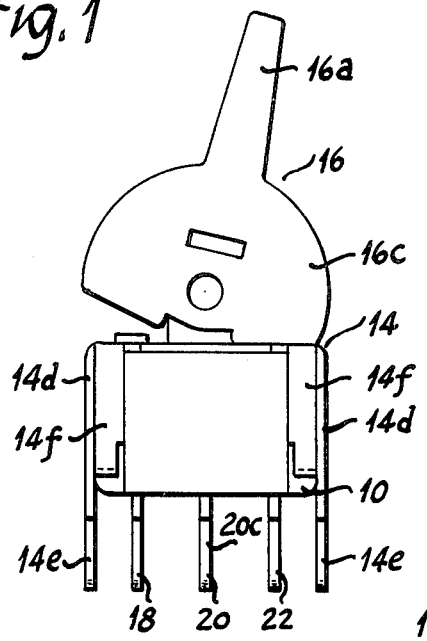
FIG. 1 is a view in side elevation of an electric switch constructed in accordance with the invention.

The switch of the present invention generally comprises main base 10, combined cover and bushing member 12, frame 14, external paddle type lever 16, and contact terminals 18, 20 and 22.

Base 10 is provided with an enlarged internal cavity in which are mounted the contact portions of contact terminals 18, 20 and 22, a contactor 24, a contactor actuator member 26, a helical compression spring 28, and the contactor operating portion **16*b* of lever 16. The contact portions of the contact terminals 18, 20 and 22 are each of the bifurcated or U-shaped form in transverse section as shown for contact terminal 20 in FIG. 3**.

Upwardly depending contact portions **20*a* and 20*b* of terminal 20 fit within vertical channels 10*a* formed between pairs of inwardly extending bosses 10*b* which are formed on the opposite inner side walls of the base cavity. The bosses 10*b* are generally rectangular in cross section and terminal below the upper end of the base. The cover and bushing member 12 seat on the upper ends of the bosses 10*b*, and seat against the upper ends of the contact portions 20*a* and 20*b* in recesses 12*a* which are spaced apart on opposite sides of the bushing portion 12*b*. The contact portions 20*a* and 20*b* integrally join with a terminal portion 20*c* which extends through a closely fitting rectangular opening formed in the bottom of the base 10**.

Contact terminals 18 and 22 as aforedescribed are provided with bifurcated or U-shaped contact portions like the portions **20*a* and 20*b* of contact terminal 20 and the upper ends of these portions fit within pairs of recesses 12*c* and 12*d* respectively found adjacent the longitudinal margins of the member 12. Members 18 and 22 near the bights thereof abut on opposite sides of boss portions 10*c* which extend centrally upwardly from the inner bottom wall of base 10. Such members then extend at a right angle towards the opposite end walls with the bar cavity and then at a right angle through closely fitting rectangular openings formed in the bottom wall of base 10**.

Figure 2:
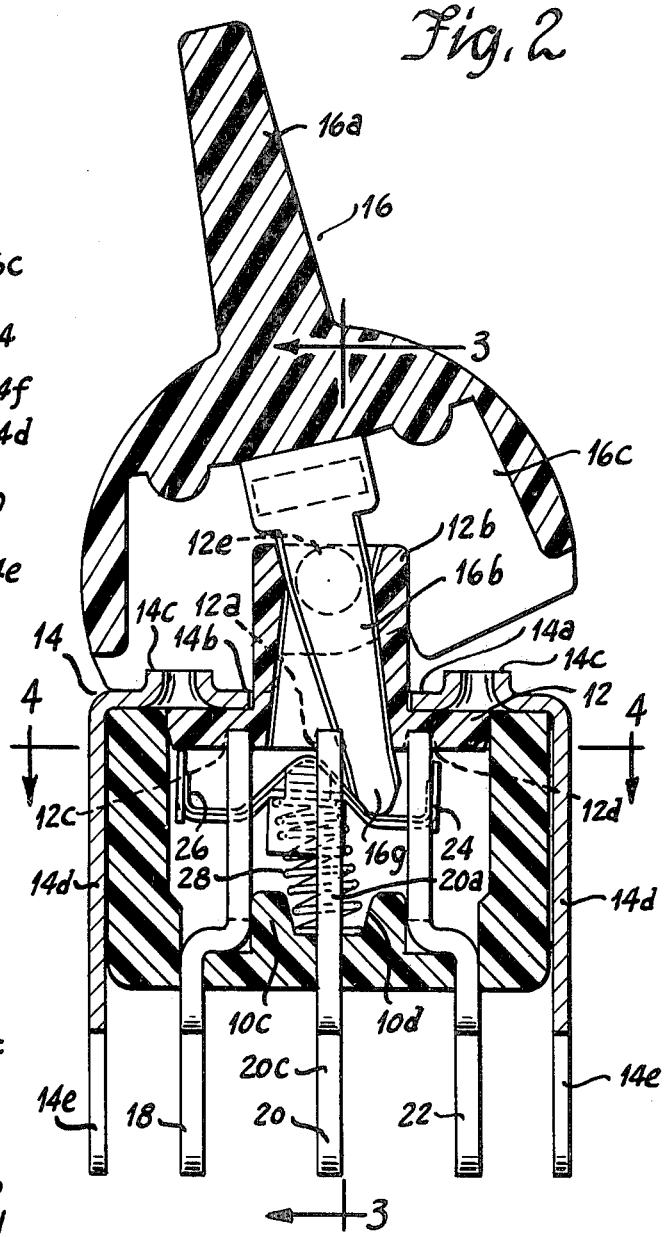
FIG. 2 is a view in longitudinal cross section, to enlarged scale, of the switch of FIG. 1.
Figure 3:
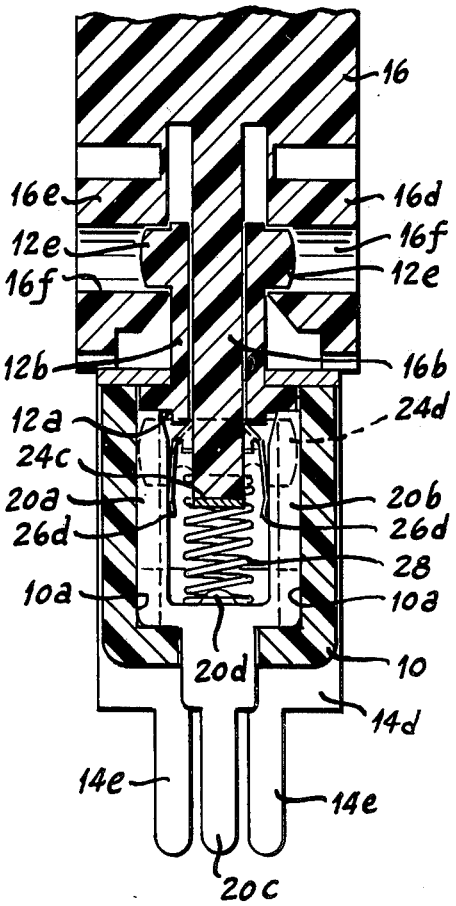
FIG. 3 is a view in transverse cross section taken along the line 3—3 of FIG. 2.
Figure 5:
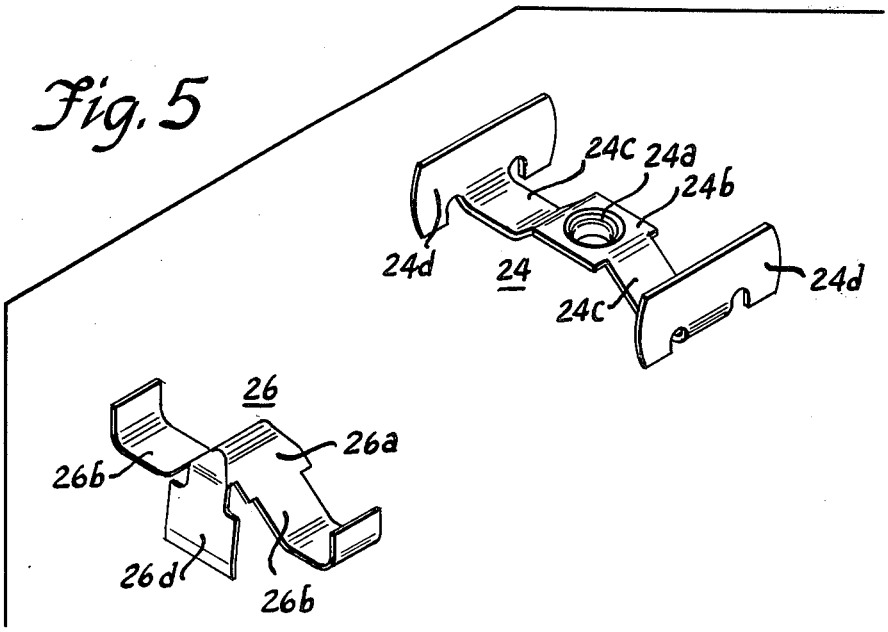
FIG. 5 is an exploded isometric view of parts of the movable contactor used in the switch.

As best shown in FIGS. 2 and 3, compression spring 28 seats as its lower end within a frusto-conical recess **10*d* formed in the boss portion 10*c* of base 10 and astride a restraining nib 20*d* which is integrally formed on the bight of contact terminal 20. At its upper end spring 28 seats against a downwardly extending hollow frusto conical boss portion 24*a* of the contactor 24. As best shown in FIG. 5, contactor 24 is integrally formed, preferably of a good electrical conducting metal such as brass, and is symmetrical about its generally square central portion 24*b*. Arm portions 24*c* angle downwardly and then laterally outwardly and merge at their ends with contact portions 24*d*** which extend upwardly at a right angle therefrom.

The contact portions **24*d* are of a width greater than the distance between the bifurcated contact portion of the contact terminal 18, 20 and 22, and as will hereinafter be more fully explained, are adapted to abut against both the contact portions of each pair of contact portions of the members 18 and 22. The central portion 24*b* and arms 24*c* of contactor 24 are relatively narrow in relation to the spaces between the bifurcated contact portions of members 18, 20 and 22** to insure good electrical clearance.

Contact actuator 26 is of the form best shown in FIG. 5, and is preferably formed of resilient, berylium-copper metal. The central portion **26*a* is of inverted V-shape and overlies in spaced apart relation the central portion 24*b* of actuator 24. Such portion 26*a* engages with the downwardly extending portions of the arms 24*c* and merges with arm portions 26*b* which overlie the outwardly extending part of arm portions 24*c* of member 24. The arm portions 26*b* at their respective ends turn upwardly at a right angle and abut against the insides of the contact portions 24*d*. At opposite sides of the central portion 26*a* are outwardly and downwardly extending flexible contact portions 26*d* which engage with the insides of the contact portions 20*a* and 20*b* of contact terminal 20 as best shown in FIG. 3**.

As best shown in FIGS. 2 and 3, the actuating lever 16 has a paddle lever **16*a* which is integrally joined with a main body portion 16*c* which is of a semicylindrical shape with depending sides 16*d* and 16*e*. The sides 16*d* and 16*e* have aligned circular apertures 16*f* which accommodate and pivot about complementally formed trunnion portions 12*e* which extend outwardly from opposite sides of the bushing portion 12*b* of member 12. The actuator lever portion 16*b* extends downwardly centrally between the sides 16*d* and 16*e* and engages at a lower hemispherical end 16*g* with the upper surface contactor actuator 26**.

The frame comprises a top portion 14*a* which overlies the cover and bushing member 12 and the upper end of base 10. A central aperture 14*b* is provided to accommodate the bushing portion 12*b* and upstanding short cylindrical bosses 14*c* on opposite sides of bushing portion are provided for a purpose hereinafter described. Frame 14 has end portions 14*d* which extend downwardly at a right angle from the portion 14*a* and abut tightly against the end walls of the base 10. Pairs of spaced apart mounting tangs 14*e* extend downwardly from each of the lower extremeties of the portions 14*d* for a purpose to later be described. The frame 14 also has four assembly fastening and securing tabs 14*f* which extend down along the sides of base 10 adjacent the corners thereof. The tabs 14*f* adjacent their lower ends are bent inwardly and clinched into recesses 10*f* formed in the outer surface of base 10. It will be seen that the aforedescribed formation and arrangement of the frame 14 provides for holding and maintaining all of the parts in the switch cavity, the bushing and cover member 12 and base 10 in assembled relation.

As shown in FIG. 2 the switch is in its operating position in which electrical circuit is completed and maintained between center or common contact terminal 20 and contact terminal 22. In this position the contact portion 26*d* of contactor actuator 26 are outwardly biased into engagement with the inner side surfaces of contact portions 20*a* and 20*b*, while the inner surface of the right hand contact portion 24*d* of contactor 24 engages with the right hand most surface of the bifurcated vertical contact portions of contact terminal 22.

Now let it be assumed that the lever 16*a* of actuating lever 16 is pivoted clockwise as viewed in FIG. 2. The end 16*g* then moves to the left, engages with and cams the inverted V-shaped portion 26*a* of member 26. This causes the latter and contactor 24 to simultaneously pivot clockwise and move downwardly and compress spring 28. With such cammed movement of actuator 26 and contactor 24, the right hand portion 24*d* of the latter slides with wiping action on the right hand surfaces of the contact portion of contact terminal 22, and the portions 26*d* of the actuator slide on the inner surface of contact portions 20*a* and 20*b*.

The above mentioned cammed movement continues until the end 16*g* of the actuator engages the apex of the central portion 26*a* of the actuator. When the end 16*g* moves over and beyond the apex, stored energy in spring 28 causes snap-action upward and longitudinal movement of members 24 and 26, thereby moving the right hand contact portion 24*d* out of engagement with the contact portion of terminal 22, and effecting abutting engagement of the left hand contact portion 24*d* with the contact portions of terminal 18. During such snap-action movement, the portions 26*d* of the actuator slide on the contact portion 20*a* and 20*b* of terminal 20.

When lever 16 is moved from its last mentioned right hand position back to its position of FIG. 2, similar movement of actuator 26 and contactor 24 will occur as the actuator and its inverted V-shaped surface are symmetrical about its center point. It will be apparent that the aforementioned sliding, wiping action of contactor 24 on the contact portions of terminals 18 and 22 will afford positive breaking of tack welds that can occur because or arcing under high current conditions, and also promotes cleaning of oxides that build up under low voltage-low current operating conditions.

As will be noted the mounting tangs 14*e* and terminal portions of contact terminals 18, 20 and 22 are of a size and shape permitting their insertion through openings on printed circuit boards so that they may be secured thereto and circuit connections made thereon by soldering. However, the switches of this invention are not limited to the exterior terminal configuration and mounting arrangements depicted, and it will be apparent that other exterior terminal forms can be readily adapted.

Figure 6:
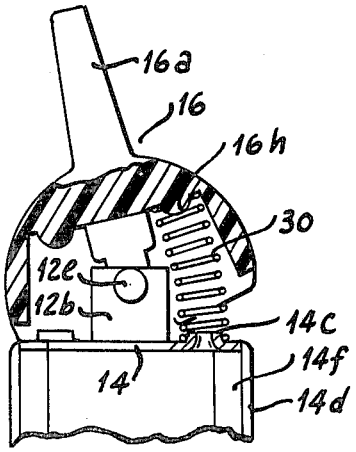
FIG. 6 is a fragmentary view of a modified form of switch incorporating the invention shown in FIGS. 1 to 5.
Figure 4:
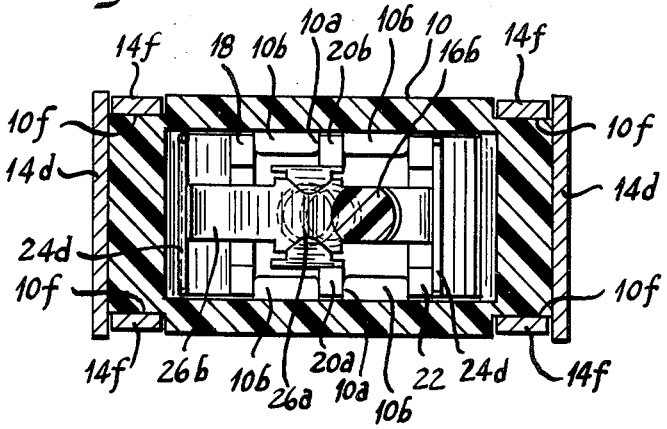
FIG. 4 is a view taken along the line 4—4 of FIG. 2.

FIG. 6 shows a modification of the switch of FIGS. 1 to 5, in which a coil compression spring 30 is disposed about and seats at its lower end about the right hand boss 14*c* on frame 14, and seats at its upper end against a hemispherical boss 16*h* formed on the lower surface of lever 16. When lever 16 is pivoted clockwise to provide the circuit interrupting and completing operations above described in connection with FIG. 2, spring 30 will be compressed. If lever 16 is then released the energy stored in the compressed spring 30 will cause lever 16 to pivot counter clockwise and restore the contactor 24 and actuator 26 to their positions shown in FIG. 2. This modified switch version of FIG. 6 provides a maintained circuit condition between contact terminals 20 and 22 and a momentary type circuit between contact terminal 18 and 20 whereas the version of FIGS. 1 to 5 provides maintained circuits in both operating positions of lever 16.

I claim:

1. In a snap-action electric switch, the combination comprising:

a housing;

at least two stationary contacts spaced apart in said housing;

movable contact means in said housing including a member having an inverted V-shaped surface;

an operator mounted on said housing having an exterior portion, and a portion within said housing which engages with said inverted V-shaped surface of said member, and spring means in said housing which engages with said movable contact means and urges said inverted V-shaped surface into engagement with the last mentioned portion of said operator, said operator being movable from one extreme position to cam said movable contact means to pivot inwardly of said housing and compress said spring means until said last mentioned portion of said operator rides over the apex of said V-shaped surface of said member, whereupon said spring means moves said contact means with snap action upwardly and longitudinally in said housing to change circuit connections between said stationary contacts.

2. A snap-action electric switch according to claim 1, wherein three spaced apart stationary contacts are provided, wherein said operator is movable between two extreme positions to move said movable contact means in the manner aforestated to interrupt and complete circuits between one and each of the other of said stationary contacts selectively, and wherein said movable contact means when pivoted inwardly of said housing slides on the stationary contacts with which it is then in engagement.

3. A snap-action electric switch according to claim 1 wherein said movable contact means comprises a metallic contactor, and a metallic actuator having an inverted V-shaped surface portion overlying and engaging with said contactor.

4. A snap-action electric switch according to claim 3, wherein said stationary contacts have bifurcated contact portions within said housing and an integral terminal portion extending exteriorlly of said housing, wherein said contactor has a main portion which is freely movable between the contact portions of said stationary contacts, and a portion disposed transversely of said main portion which is adapted to bridge and engage with the contact portions of one of said stationary contacts in one extreme position of said movable contact means, and wherein said actuator has laterally depending portions which slide on and are in continuous engagement with the contact portions of another of said stationary contacts.

5. A snap-action electric switch according to claim 3 wherein said spring means is a coiled compression spring seated at one end in said base astride the bight of said contact portions of said other of said stationary contacts and at its other end against said contactor, and wherein said contactor has a transversely disposed portion at both ends of said main portion.

6. A snap-action electric switch according to claim 5 wherein said movable operator is a lever pivoted on said housing with an end within said housing which is in engagement with and slides on the inverted V-shaped surface of said actuator, and a portion exterior of said housing which is engageable to pivot said lever between two extreme positions to effect the aforestated pivotal and snap-action movements of said contactor and said actuator.

7. A snap-action electric switch according to claim 6, wherein a coil compression spring mounted exteriorally of said housing between the latter and said lever is compressed by pivotal movement of said lever in one direction and provides when so compressed for return of said lever to its initial position when released.

* * * * *